US006613594B1

(12) United States Patent
Lansford et al.

(10) Patent No.: US 6,613,594 B1
(45) Date of Patent: Sep. 2, 2003

(54) SURFACE PLASMON RESONANCE-BASED ENDPOINT DETECTION FOR CHEMICAL MECHANICAL PLANARIZATION (CMP)

(75) Inventors: Christopher Hans Lansford, Austin, TX (US); Jeremy Sam Lansford, Austin, TX (US)

(73) Assignee: Advanced Micro Devices, INC, Austin, TX (US)

( * ) Notice: Subject to any disclaimer, the term of this patent is extended or adjusted under 35 U.S.C. 154(b) by 0 days.

(21) Appl. No.: 10/040,325

(22) Filed: Nov. 7, 2001

(51) Int. Cl.[7] ..... H01L 21/66
(52) U.S. Cl. ..... 438/16; 438/626
(58) Field of Search ..... 356/445; 438/16.622, 438/626

(56) References Cited

U.S. PATENT DOCUMENTS 5,508,809 A * 4/1996 Peacock et al. ..... 356/445
6,424,418 B2 * 7/2002 Kawabata et al. ..... 356/445

* cited by examiner

*Primary Examiner*—Kamand Cuneo
*Assistant Examiner*—Asok Kumar Sarkar
(74) *Attorney, Agent, or Firm*—Williams, Morgan & Amerson

(57) ABSTRACT

A method is provided, the method comprising planarizing a dielectric layer disposed above a structure layer, exciting surface plasmons in a conductive film disposed in the dielectric layer and detecting photons reflected from the conductive film to determine a change in a surface plasmon resonant angle. The method also comprises determining a thickness of the dielectric layer from the change in the surface plasmon resonant angle.

38 Claims, 10 Drawing Sheets

SURFACE PLASMON RESONANCE-BASED ENDPOINT DETECTION FOR CHEMICAL MECHANICAL PLANARIZATION (CMP)

BACKGROUND OF THE INVENTION

1. Field of the invention

This invention relates generally to semiconductor fabrication technology, and, more particularly, to a method for process monitoring during semiconductor fabrication.

2. Description of the Related Art

There is a constant drive within the semiconductor industry to improve the quality and reliability of integrated circuit devices, e.g., microprocessors, memory devices, and the like. Accordingly, the technologies underlying semiconductor processing tools have attracted increased attention over the last several years, resulting in substantial refinements. However, despite the advances made in this area, many of the processing tools that are currently commercially available suffer certain deficiencies. In particular, such tools often lack advanced process data monitoring capabilities, such as the ability to provide historical parametric data, as well as event logging, real-time graphical display of both current processing parameters and the processing parameters of the entire run, and remote monitoring.

These deficiencies can engender nonoptimal control of critical processing parameters, such as processing temperatures, mechanical tool parameters, film composition, and the like. This variability manifests itself as within-run disparities, run-to-run disparities and tool-to-tool disparities that can propagate into deviations in product quality and performance, whereas an improved monitoring and diagnostics system for such tools would provide a means of monitoring this variability, as well as providing means for optimizing control of critical parameters. Further, effective control of a process like chemical mechanical planarization (CMP) can be used to compensate for variability introduced in previous steps such as variation in deposited dielectric film thickness.

Currently, chemical mechanical planarization (CMP) tools that use endpoint detection rely either on (1) laser interferometry or (2) the difference in frictional properties of the various layers in the device (giving rise to measurable changes in the required motor drive current). Neither method is adequate to repeatably and accurately signal an endpoint within a single layer, for example, if one wants to polish only half-way through a silicon dioxide ($SiO_2$) layer. Currently, endpoint detection is not generally used for such tasks. Instead, send-ahead test wafers are typically used to determine optimum polish times for a given lot, reducing tool throughput and increasing manufacturing costs.

The present invention is directed to overcoming, or at least reducing the effects of, one or more of the problems set forth above.

SUMMARY OF THE INVENTION

In one aspect of the present invention, a method is provided, the method comprising planarizing a dielectric layer disposed above a structure layer, exciting surface plasmons in a conductive film disposed in the dielectric layer and detecting photons reflected from the conductive film to determine a change in a surface plasmon resonant angle. The method also comprises determining a thickness of the dielectric layer from the change in the surface plasmon resonant angle.

In another aspect of the present invention, a device is provided, the device comprising a conductive film disposed in a dielectric layer, the conductive film capable of having surface plasmons excited therein, and a detector adapted to detect photons reflected from the dielectric layer to determine a change in a surface plasmon resonant angle. The method also comprises an endpoint detector adapted to detect the endpoint in planarization based on the determination of the change in the surface plasmon resonant angle.

BRIEF DESCRIPTION OF THE DRAWINGS

The invention may be understood by reference to the following description taken in conjunction with the accompanying drawings, in which the leftmost significant digit(s) in the reference numerals denote(s) the first figure in which the respective reference numerals appear, and in which:

FIG. 1 schematically illustrates in cross-section and in blow-up various embodiments of a method and a device for manufacturing according to the present invention;

FIG. 2 schematically illustrates reflectivity shifts for the various embodiments shown in FIG. 1;

FIGS. 3–12 schematically illustrate in cross-section various embodiments of methods of manufacturing for the various embodiments shown in FIG. 1;

FIG. 13 schematically illustrates in cross-section and in blow-up various alternative embodiments of a method and a device for manufacturing according to the present invention;

FIG. 14 schematically illustrates reflectivity shifts for the various alternative embodiments shown in FIG. 13;

FIG. 15 schematically illustrates another method for fabricating a semiconductor device practiced in accordance with the present invention; and FIG. 16 schematically illustrates workpieces being processed using a processing tool in accordance with the present invention.

Figure 1:
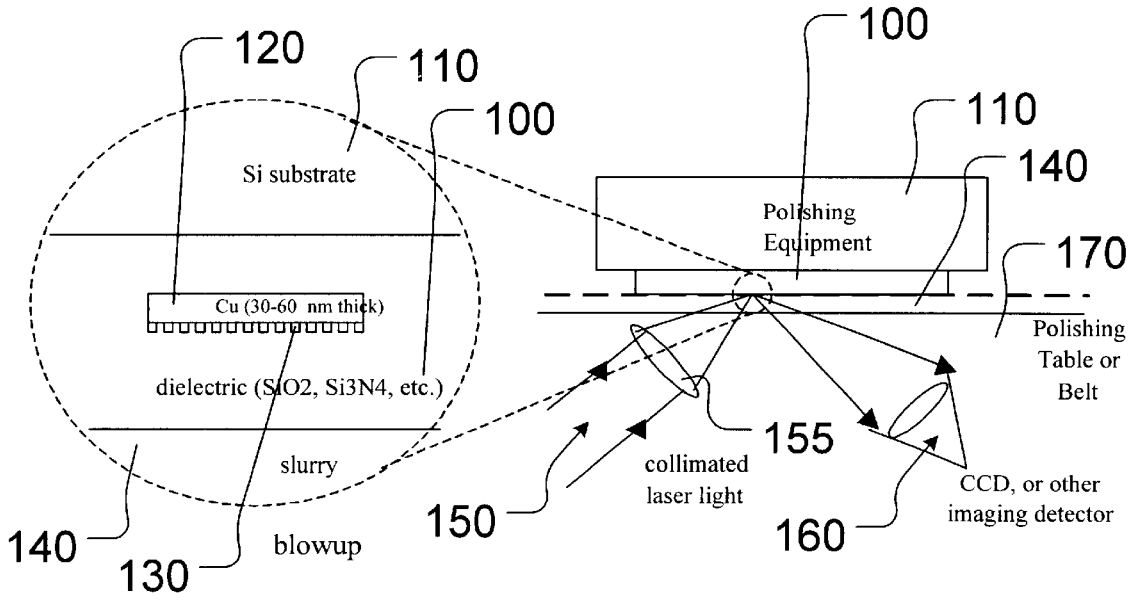
FIGS. 1–16 schematically illustrate various embodiments of a method and a device for manufacturing according to the present invention; and, more particularly.

While the invention is susceptible to various modifications and alternative forms, specific embodiments thereof have been shown by way of example in the drawings and are herein described in detail. It should be understood, however, that the description herein of specific embodiments is not intended to limit the invention to the particular forms disclosed, but on the contrary, the intention is to cover all modifications, equivalents, and alternatives falling within the spirit and scope of the invention as defined by the appended claims.

DETAILED DESCRIPTION OF SPECIFIC EMBODIMENTS

Illustrative embodiments of the invention are described below. In the interest of clarity, not all features of an actual implementation are described in this specification. It will of course be appreciated that in the development of any such actual embodiment, numerous implementation-specific decisions must be made to achieve the developers' specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

Illustrative embodiments of a method and a device according to the present invention are shown in FIGS. 1–16.

There are numerous experimental configurations that can be used to interface surface plasmon resonance (SPR) with multilayer integrated circuit (IC) technologies. Surface plasmon resonance (SPR) techniques may be used for chemical mechanical planarization (CMP) endpoint detection. The specific illustrative embodiments and/or experimental configurations described in more detail below are not limiting, and several possible configurations will be described for the sake of clarity.

As shown in FIG. 1, a portion of each workpiece or wafer 110 would be devoted to one or more test structures comprising a conductive film 120, such as a copper (Cu) film, a silver (Ag) film, a gold (Au) film, and the like, bounded by one or more dielectric layers 100 on all sides. The conductive film 120 may be formed to have a thickness t (FIG. 7) in a range of about 200 Å to about 800 Å.

A grating 130 may be formed on the conductive film 120. For example, a damascene process may be used to form the grating 130, as described more fully below. Alternatively, such films 120 may be patterned to form the grating 130. For example, grooves may be used to form the grating 130, as described more fully below. The grating 130 may be formed to have a depth d (FIG. 7) in a range of about 25 Å to about 200 Å and to have a grating spacing w (FIG. 7) in a range of about 5000 Å to about 15000 Å.

The test structures may be as small as about tens of microns in area, although 1 mm×1 mm or so may also be convenient. The test structures may be located in non-die areas of the workpiece 110, such as in scoring areas between dies on the workpiece 110.

Light polarized perpendicular to the plane of the conductive film 120 (p-polarized light) incident at a resonance angle will excite surface plasmons in the conductive film 120 by the surface plasmon effect. The surface plasmon effect is described, for example, by H. Raether, *Surface Plasmons*, New York: Springer-Verlag, 136pp, 1988. If collimated laser light 150 is focused on the conductive film 120 with a cylindrical lens 155, individual photons will be incident at a number of angles; each incident angle corresponds to a particular row on a charge-coupled device (CCD) detector 160. In alternative illustrative embodiments, another type of imaging detector may be used. Since photons that satisfy the surface plasmon resonance (SPR) condition will be coupled into the conductive film 120 (and therefore not reflected), there will be a minimum in the reflected light intensity at the detector pixels corresponding to the resonant angle. Because the electric field of the excited surface plasmon extends into the dielectric layer(s) 100 above and below the monitor conductive film 120, the resonant angle is extremely sensitive to the properties of any dielectric materials within about a micron (10000 Å) of the monitor conductive film 120 (in the direction perpendicular to the conductive film 120). Since the dielectric properties of the dielectric layer(s) 100, along with any polish slurry 140 that is within the about 10000 Å penetration depth of the plasmon field, change dramatically during polishing, the surface plasmon resonance (SPR) angle is extremely sensitive to dielectric thickness.

Figure 2:
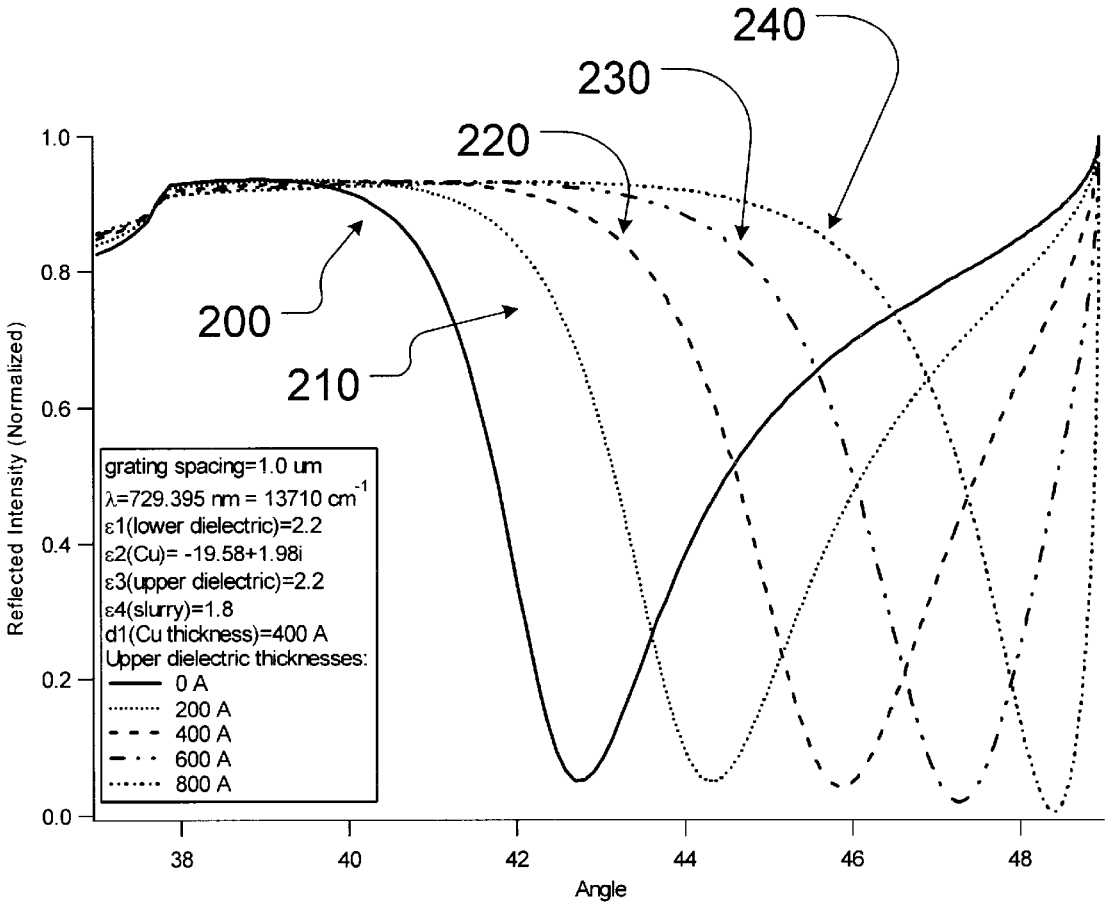

To illustrate the sensitivity of this approach, consider FIG. 2, calculated using a 4-layer model for the electric field (as described, for example, by Drake and Bohn, *Anal. Chem.* 67(11): 1766–1771, Jun. 1, 1995) and film properties shown in the figure inset. The calculations illustrated schematically in FIG. 2 use: wavelength $\lambda$=729.395 nm (corresponding to wave number k =13710 $cm^{-1}$), dielectric constant $\epsilon_1$=2.2 for the portion of the dielectric layer 100 between the conductive film 120 and the workpiece 110, dielectric constant $\epsilon_2$=−19.58 +1.98 i for the conductive film 120, dielectric constant $\epsilon_3$=2.2 for the portion of the dielectric layer 100 between the grating 130 and the interface (indicated in phantom) with the slurry 140, dielectric constant $\epsilon_4$=1.8 for the slurry 140, conductive film 120 thickness t (FIG. 7) of about 400 Å and a grating with about 1000 grooves/mm (compare, for example, FIG. 7 with a grating spacing w of about 10000 Å), coupled in first order. Reflected intensity curves 200, 210, 220, 230 and 240 correspond to thicknesses of about 0 Å, 200 Å, 400 Å, 600 Å and 800 Å, respectively, for the portion of the dielectric layer 100 between the grating 130 and the interface (indicated in phantom) with the slurry 140.

The angles on the x-axis are illustrated for illustrative embodiments having a grating (similar to the grating 130) and the grating-coupled surface plasmon resonance (SPR). Note that the shift in the reflectivity minimum is related to the dielectric thickness of the portion of the dielectric layer 100 between the grating 130 and the interface (indicated in phantom) with the slurry 140. Also note that a change in dielectric thickness of only about 1 Å corresponds to a change in resonant angle of about 0.02°, a readily measurable value.

To interface monitoring the surface plasmon resonance (SPR) angle of the monitor pads with standard chemical mechanical planarizing (CMP) systems, in which the wafers or workpieces 110 are generally rotated or oscillated, a number of approaches are possible. In various illustrative embodiments, a window in the table or belt 170 may allow the collimated laser beam 150 in and out. The detection electronics may be triggered to record surface plasmon resonance (SPR) images and determine the resonance angle at the rotation or oscillation rate of the workpiece 110 (so that the monitor pad may be in registry with the window when each image is recorded).

Figure 3:
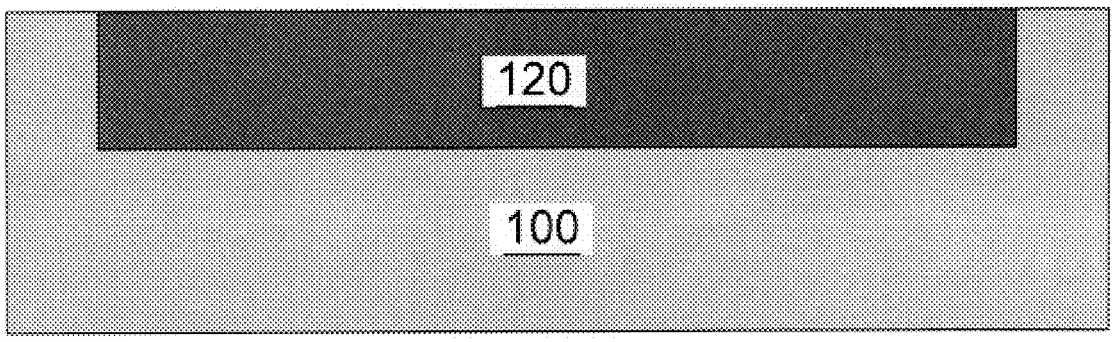
Figure 4:
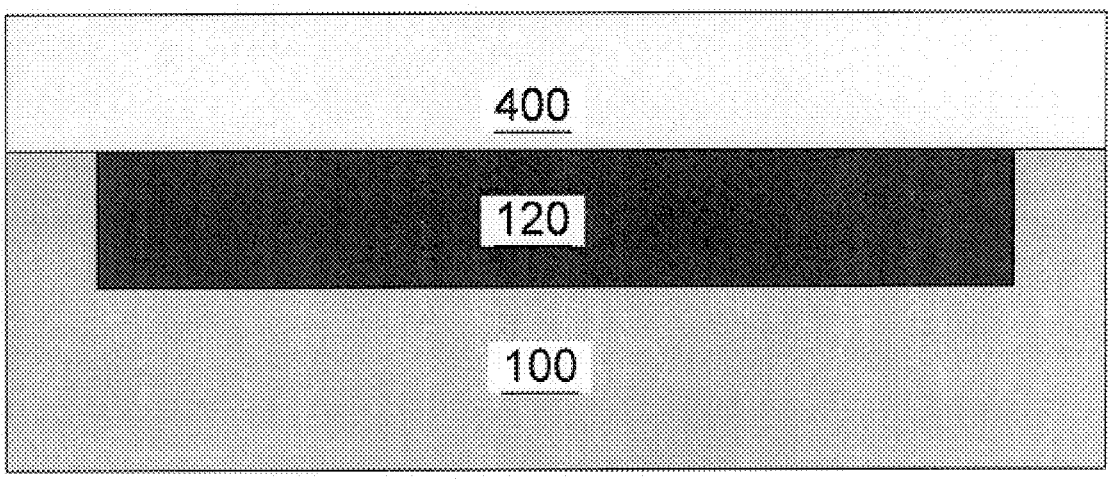
Figure 5:
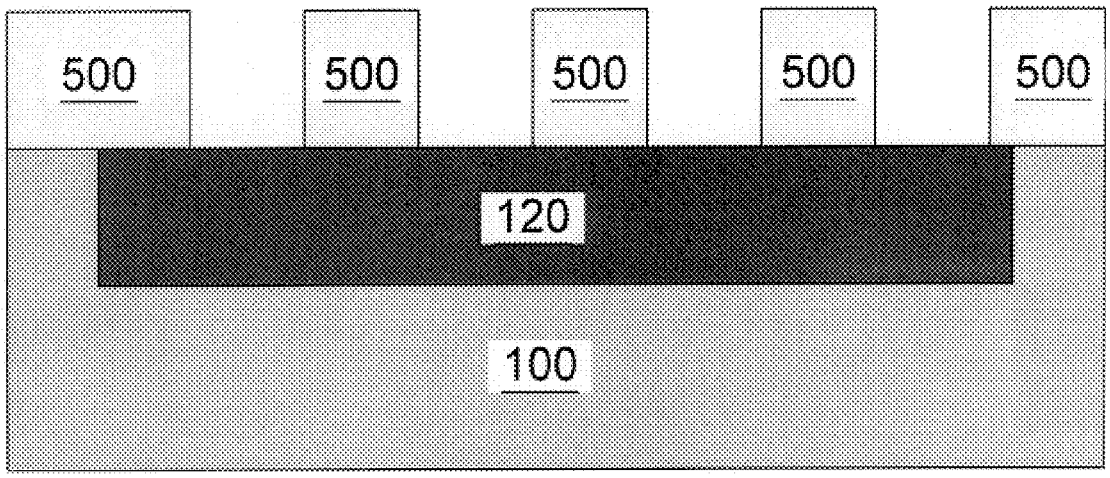
Figure 6:
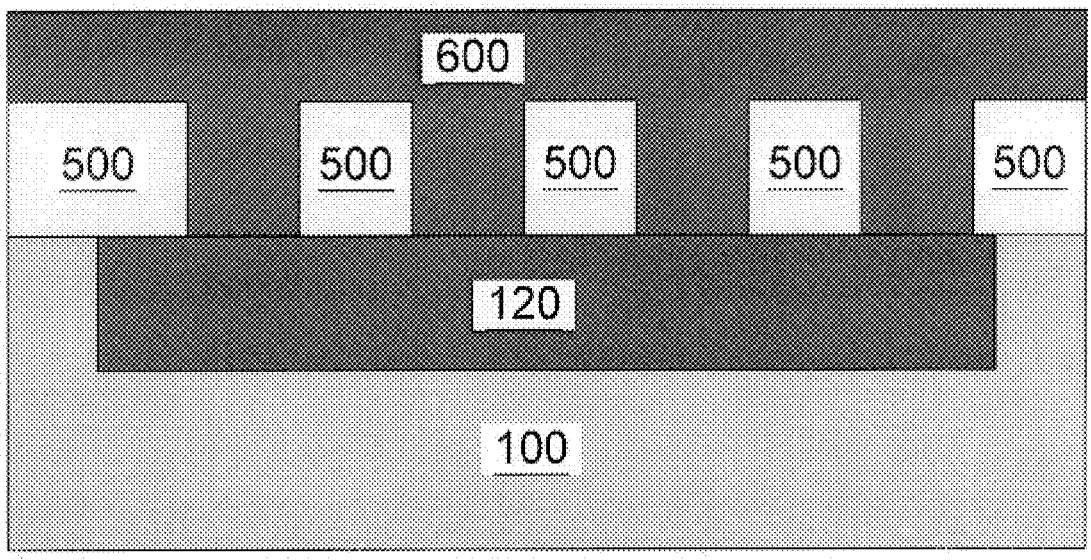
Figure 7:
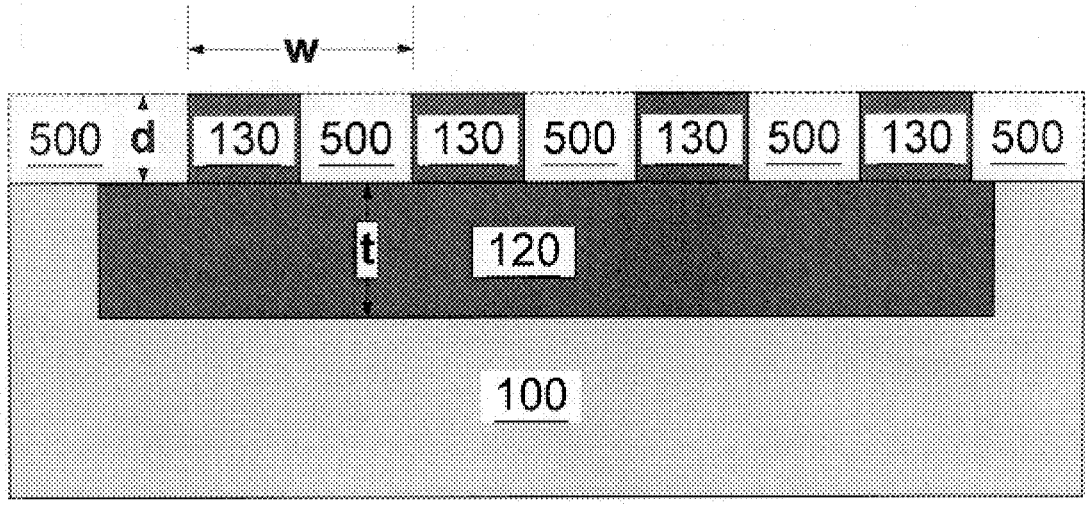

FIGS. 3–12 schematically illustrate in cross-section various embodiments of methods of manufacturing for the various embodiments shown in FIG. 1. As shown in FIG. 3, the conductive film 120 may be formed in a portion of the dielectric layer 100. As shown in FIG. 4, another dielectric layer 400 may be formed above the conductive film 120 and the dielectric layer 100. As shown in FIG. 5, the dielectric layer 400 may be patterned above the conductive film 120 to form dielectric portions 500. As shown in FIG. 6, a conductive layer 600 may be formed above and adjacent the conductive film 120 and the dielectric portions 500. As shown in FIG. 7, the conductive layer 600 (and, optionally, the dielectric portions 500, as shown in phantom, unless previously removed) may be planarized to form the grating 130.

Figure 8:
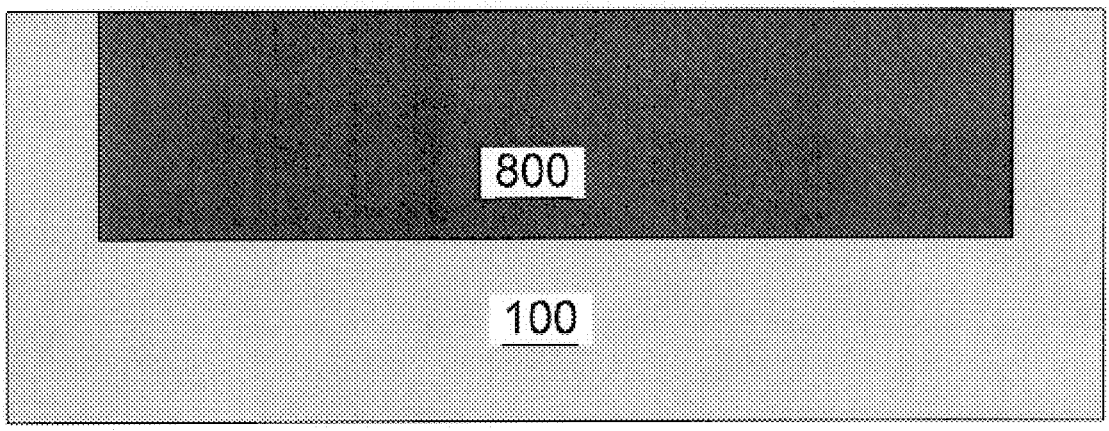
Figure 9:
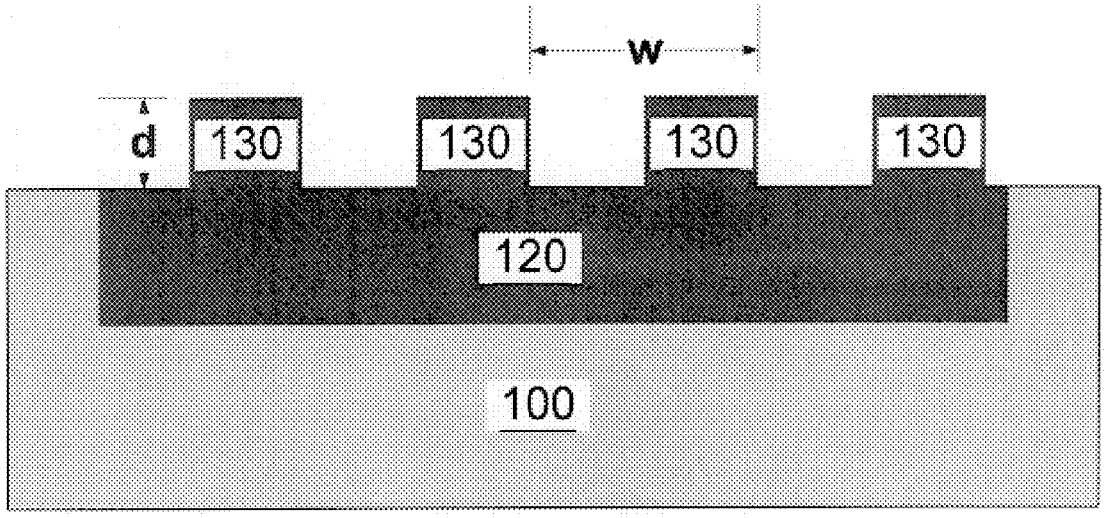
Figure 10:
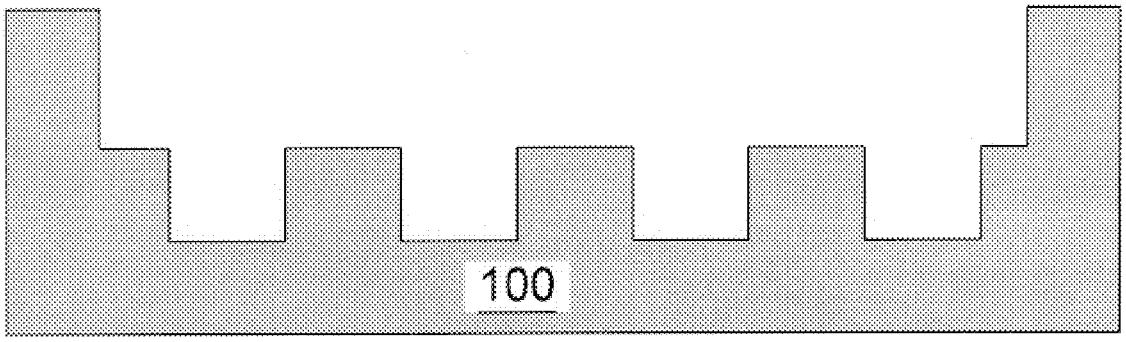
Figure 11:
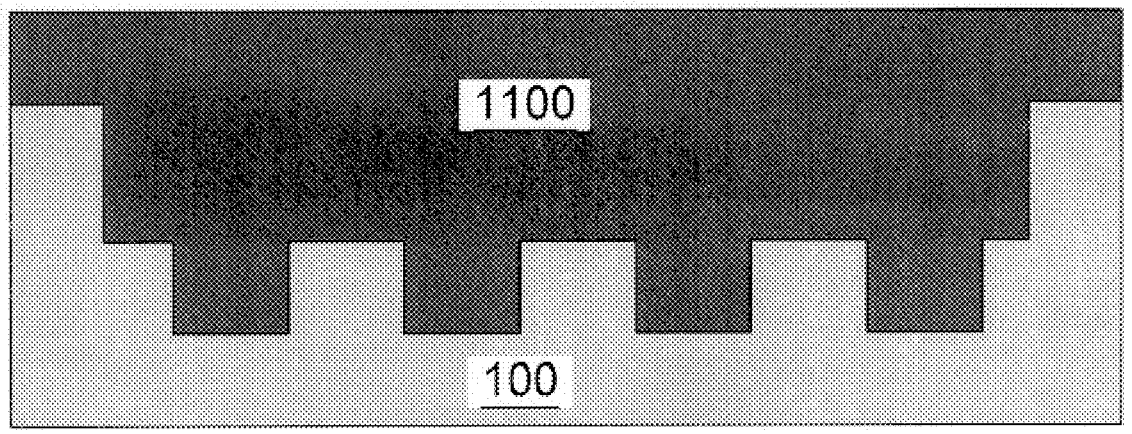
Figure 12:
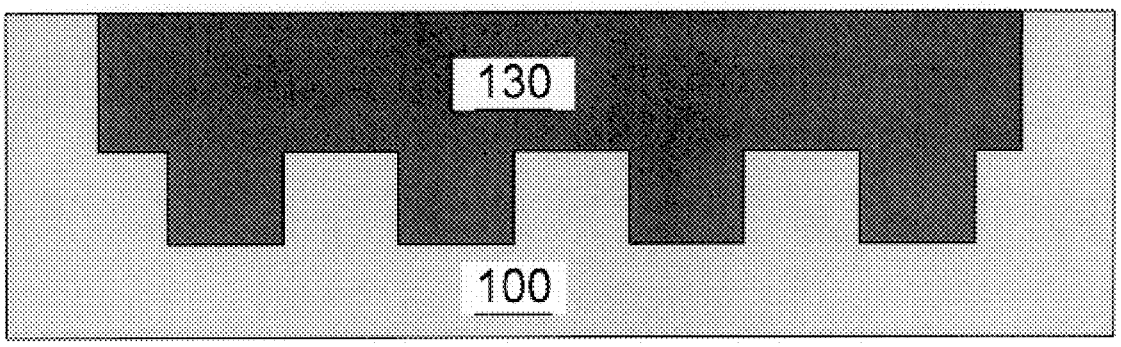
Figure 13:
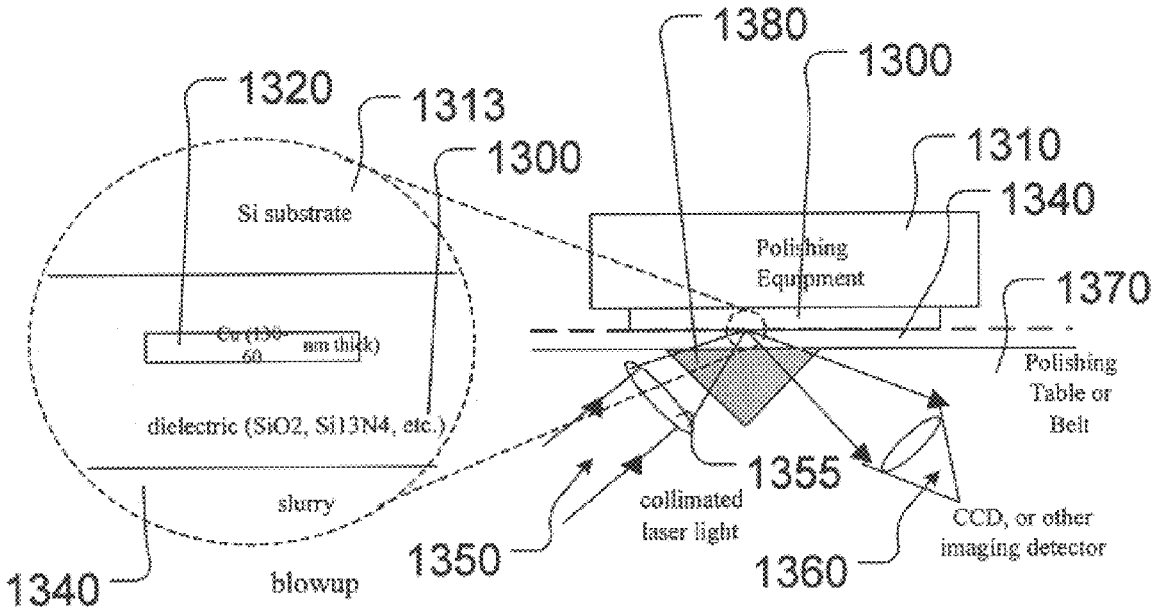

In various alternative illustrative embodiments, as shown in FIG. 8, a conductive structure 800 may be formed in a portion of the dielectric layer 100. As shown in FIG. 9, the conductive structure 800 may be scored and/or grooved to form the grating 130. As shown in FIG. 10, the dielectric layer 100 may be patterned to form trenches of differing widths and depths, for dual damascene processing. As shown in FIG. 11, a conductive layer 1100 may be formed above and adjacent the patterned dielectric layer 100. As shown in FIG. 12, the conductive layer 1100 may be planarized to form the grating 130 (inverted relative to the grating 130 as shown in FIGS. 7 and 9). As shown in FIG. 13, instead of exciting the surface plasmons with a grating (such as the grating 130 shown in FIG. 1) as described so far, the surface plasmons may also be excited using a prism 1380 in the Otto configuration (as described, for example, by H.

Raether, *Surface Plasmons*, New York: Springer-Verlag, at p. 11). In these alternative illustrative embodiments, the prism 1380 may be mounted into the table 1370 of the chemical mechanical planarizing (CMP) tool so that there may be a gap of about 2000 Å to about 10000 Å between the prism 1380 and dielectric layer 1310 surface. Excitation light may internally reflect off the prism 1380 and excite surface plasmons evanescently. This configuration has an advantage in that a grating (such as the grating 130 shown in FIG. 1) atop a conductive film 1320, such as a copper (Cu) film, a silver (Ag) film, a gold (Au) film, and the like, would be unnecessary.

As shown in FIG. 13, a portion of each workpiece or wafer 1310 would be devoted to one or more test, structures comprising the conductive film 1320, such as a copper (Cu) film, a silver (Ag) film, a gold (Au) film, and the like, bounded by one or more dielectric layers 1300 on all sides. The conductive film 1320 may be formed to have a thickness t (FIG. 7) in a range of about 200 Å to about 800 Å.

The test structures may be as small as about tens of microns in area, although 1 mm×1 mm or so may also be convenient. The test structures may be located in non-die areas of the workpiece 1310, such as in scoring areas between dies on the workpiece 1310.

Light polarized perpendicular to the plane of the conductive film 1320 (p-polarized light) incident at a resonance angle will excite surface plasmons in the conductive film 1320 by the surface plasmon effect. If collimated laser light 1350 is focused on the conductive film 1320 with a cylindricai lens 1355, individual photons will be incident at a number of angles; each incident angle corresponds to a particular row on a charge-coupled device (CCD) detector 1360. In alternative illustrative embodiments, another type of imaging detector may be used. Since photons that satisfy the surface plasmon resonance (SPR) condition will be coupled into the conductive film 1320 (and therefore not reflected), there will be a minimum in the reflected light intensity at the detector pixels corresponding to the resonant angle. Because the electric field of the excited surface plasmon extends into the dielectric layer(s) 1300 above and below the monitor conductive film 1320, the resonant angle is extremely sensitive to the properties of any dielectric materials within about a micron (10000 Å) of the monitor conductive film 1320 (in the direction perpendicular to the conductive film 1320). Since the dielectric properties of the dielectric layer(s) 1300, along with any polish slurry 1340 that is within the about 10000 Å penetration depth of the plasmon field, change dramatically during polishing, the surface plasmon resonance (SPR) angle is extremely sensitive to dielectric thickness.

Figure 14:
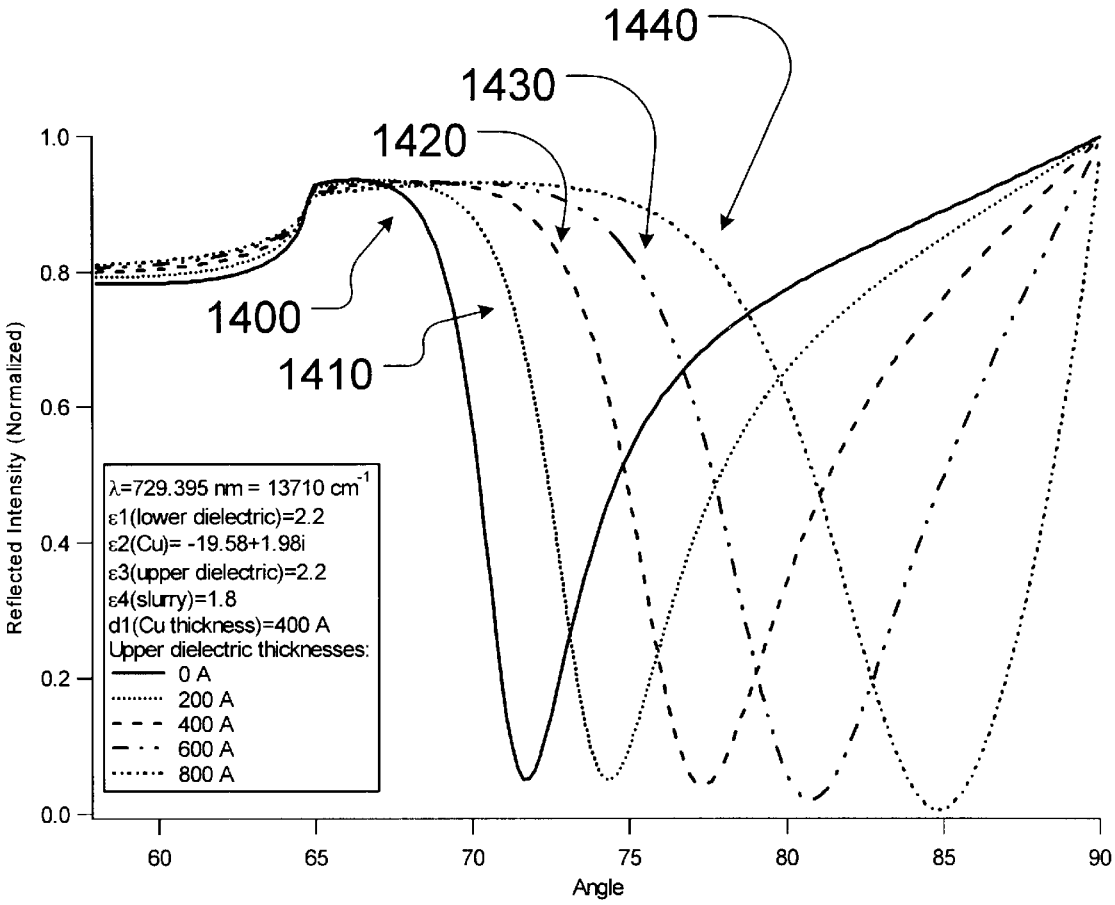

To illustrate the sensitivity of this approach, consider FIG. 14, calculated using a 4-layer model for the electric field (as described, for example, by Drake and Bohn, *Anal. Chem.* 67(11): 1766–1771, Jun. 1, 1995) and film properties shown in the figure inset. The calculations illustrated schematically in FIG. 14 use: wavelength $\lambda$=729.395 nm (corresponding to wave number k=13710 $cm^{-1}$), dielectric constant $\epsilon_1$=2.2 for the portion of the dielectric layer 1300 between the conductive film 1320 and the workpiece 1310, dielectric constant $\epsilon_2$=−19.58+1.98 i for the conductive film 1320, dielectric constant $\epsilon_3$=2.2 for the portion of the dielectric layer 1300 between the conductive film 1320 and the interface (indicated in phantom) with the slurry 1340, dielectric constant $\epsilon_4$=1.8 for the slurry 1340, conductive film 1320 thickness t (FIG. 7) of about 400 Å. Reflected intensity curves 1400, 1410, 1420, 1430 and 1440 correspond to thicknesses of about 0 Å, 200 Å, 400 Å, 600 Å and 800 Å, respectively, for the portion of the dielectric layer 1300 between the conductive film 1320 and the interface (indicated in phantom) with the slurry 1340.

Note that the shift in the reflectivity minimum is roughly proportional to the dielectric thickness of the portion of the dielectric layer 1300 between the conductive film 1320 and the interface (indicated in phantom) with the slurry 1340. Also note that a change in dielectric thickness of only about 1 Å corresponds to a change in resonant angle of about 0.02°, a readily measurable value.

To interface monitoring the surface plasmon resonance (SPR) angle of the monitor pads with standard chemical mechanical planarizing (CMP) systems, in which the wafers or workpieces 1310 are generally rotated or oscillated, a number of approaches are possible. In various illustrative embodiments, a window in the table or belt 1370 may allow the collimated laser beam 1350 in and out. The detection electronics may be triggered to record surface plasmon resonance (SPR) images and determine the resonance angle at the rotation or oscillation rate of the workpiece 1310 (so that the monitor pad may be in registry with the window when each image is recorded).

In various alternative illustrative embodiments, the surface plasmon resonance (SPR) may be measured in an imaging mode. Instead of focusing the incident beam as described above, which creates numerous incident angles, a collimated beam may be used, providing essentially a single incident angle. The surface plasmon resonance (SPR) shift may be detected simply by changes in reflected intensity at that single angle. These illustrative embodiments enable detection strategies that image large portions of the wafer surface, but may be relatively more susceptible to convolution with other physical processes that affect reflected intensity measurements, such as like incident power fluctuations, absorption, scattering, non-specular reflection, interferometric effects, and the like. Since only p-polarized light can excite surface plasmon modes, normalizing the p-polarized reflectivity with the s-polarized reflectivity may ameliorate such problems.

Figure 15:
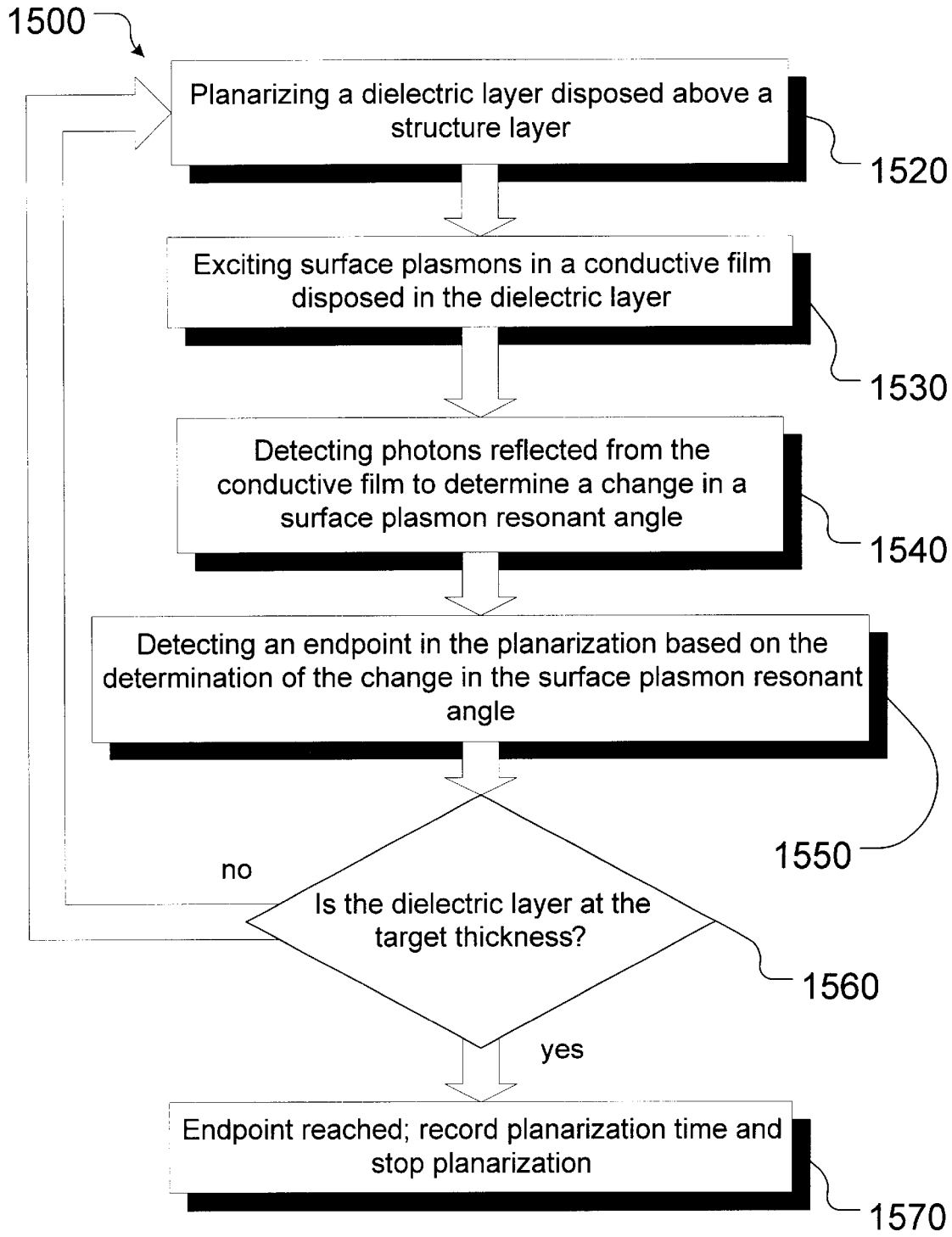
Figure 16:
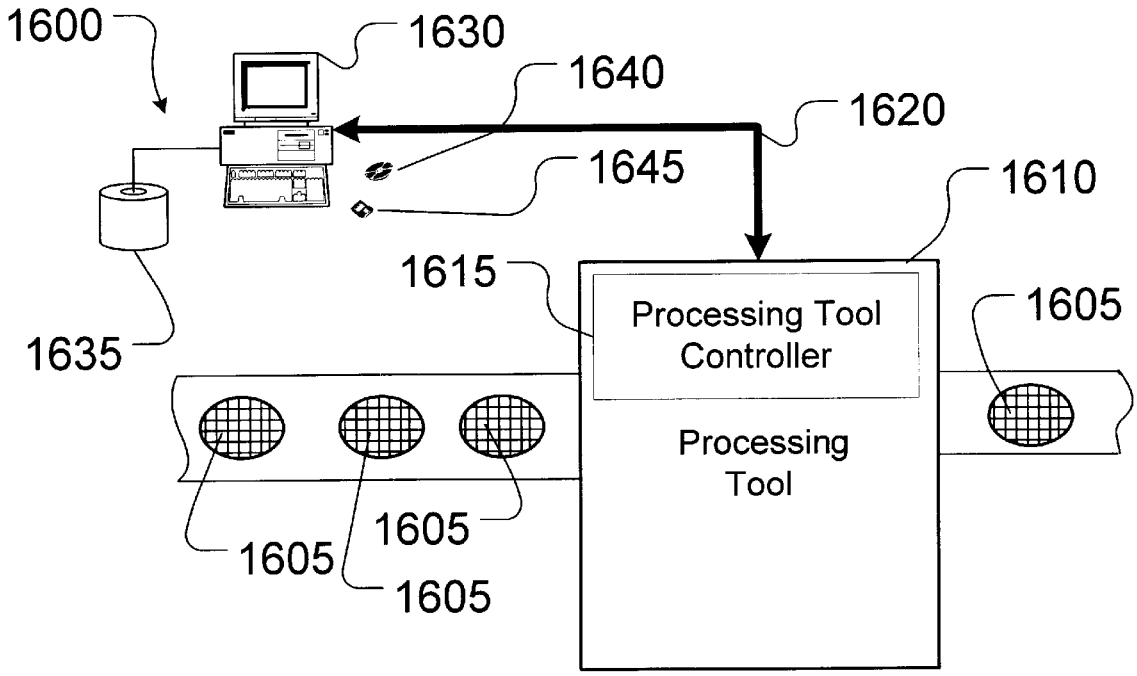

FIG. 15 illustrates one particular embodiment of a method 1500 practiced in accordance with the present invention. FIG. 16 Illustrates one particular apparatus 1600 with which the method 1500 may be practiced. For the sake of clarity, and to further an understanding of the invention, the method 1500 shall be disclosed in the context of the apparatus 1600. However, the invention is not so limited and admits wide variation, as is discussed further below.

Referring now to both FIGS. 15 and 16, a batch or lot of workpieces or wafers 1605 is being processed through a chemical mechanical planarization (CMP) processing tool 1610. The chemical mechanical planarization (CMP) processing tool 1610 may be any chemical mechanical planarization (CMP) processing tool known to the art, provided it comprises the requisite control capabilities. The chemical mechanical planarization (CMP) processing tool 1610 comprises a chemical mechanical planarization (CMP) processing tool controller 1615 for this purpose. The nature and function of the chemical mechanical planarization (CMP) processing tool controller 1615 will be implementation specific. Four workpieces 1605 are shown in FIG. 16, but the lot of workpieces or wafers, i.e., the "wafer lot," may be any practicable number of wafers from one to any finite number.

The method 1500 begins, as set forth in box 1520, by planarizing a dielectric layer disposed above a structure layer. The method 1500 continues, as set forth in box 1530, by exciting surface plasmons in a conductive film disposed in the dielectric layer, as described above. The method 1500 proceeds by detecting photons reflected from the conductive film to determine a change in a surface plasmon resonant angle, as set forth in box 1540 and as described above. In various illustrative embodiments, the computer system 1630 in FIG. 16 is programmed to calculate and/or determine the thickness of the dielectric layer from the change in the surface plasmon resonant angle. If the targeted dielectric thickness has not been achieved, planarization may continue (or may be restarted) and the cycle may be repeated.

Turning to FIG. 16, in various illustrative embodiments, the changes in the surface plasmon resonant angle corresponding to the change in the thickness of the dielectric layer due to the processing performed in the chemical mechanical planarization (CMP) processing tool 1610 are measured and/or monitored by tool sensors (not shown). The outputs of these tool sensors are transmitted to a computer system 1630 over a line 1620. The computer system 1630 analyzes these sensor outputs to identify the changes in the surface plasmon resonant angle corresponding to the change in the thickness of the dielectric layer.

In the embodiment of FIG. 16, a database 1635 stores a plurality of models that might potentially be applied. The computer system 1630 then extracts an appropriate model from the database 1635 of potential models to apply to the reflectivity data. The database 1635 may be stored on any kind of computer-readable, program storage medium, such as an optical disk 1640, a floppy disk 1645, or a hard disk drive (not shown) of the computer system 1630. The database 1635 may also be stored on a separate computer system (not shown) that interfaces with the computer system 1630.

Modeling of the reflectivity data may be implemented differently in alternative embodiments. For instance, the computer system 1630 may be programmed using some form of artificial intelligence to analyze the sensor outputs and controller inputs to develop a model on-the-fly in a real-time implementation.

The method 1500 of FIG. 15 then proceeds by determining a thickness of the dielectric layer from the change in the surface plasmon resonant angle, as set forth in box 1550. For example, the change in the surface plasmon resonant angle may indicate that the planarization has sufficiently changed the initial thickness of the dielectric layer to achieve a desired final thickness of the dielectric layer. The appropriate control input (for example, "stop polishing") may then be formulated and transmitted to the chemical mechanical planarization (CMP) processing tool controller 1615 over the line 1620. The chemical mechanical planarization (CMP) processing tool controller 1615 then controls subsequent processing operations in accordance with the appropriate control inputs.

In various illustrative embodiments, a decision point 1560 may be reached, the decision point 1560 posing the question "Is the dielectric layer at the target thickness?" If the answer is "no," the processing may return to planarizing the dielectric layer, as indicated by the arrow connecting the decision point 1560 to the box 1520. If the answer is "yes," the endpoint may be reached and processing may proceed to record the planarization time and stop the planarization, as indicated by the arrow connecting the decision point 1560 to the box 1570.

Some alternative embodiments may employ a form of feedback to improve the modeling of the reflectivity and thickness data. The implementation of this feedback is dependent on several disparate facts, comprising the tool's sensing capabilities and economics. One technique for doing this would be to monitor at least one effect of the model's implementation and update the model based on the effect(s) monitored. The update may also depend on the model. For instance, a linear model may require a different update than would a non-linear model, all other factors being the same.

As is evident from the discussion above, some features of the present invention may be implemented in software. For instance, the acts set forth in the boxes 1520–1550 in FIG. 15 are, in the illustrated embodiment, software-implemented, in whole or in part. Thus, some features of the present invention are implemented as instructions encoded on a computer-readable, program storage medium. The program storage medium may be of any type suitable to the particular implementation. However, the program storage medium will typically be magnetic, such as the floppy disk 1645 or the computer 1630 hard disk drive (not shown), or optical, such as the optical disk 1640. When these instructions are executed by a computer, they perform the disclosed functions. The computer may be a desktop computer, such as the computer 1630. However, the computer might alternatively be a processor embedded in the processing tool 1610. The computer might also be a laptop, a workstation, or a mainframe in various other embodiments. The scope of the invention is not limited by the type or nature of the program storage medium or computer with which embodiments of the invention might be implemented.

Thus, some portions of the detailed descriptions herein are, or may be, presented in terms of algorithms, functions, techniques, and/or processes. These terms enable those skilled in the art most effectively to convey the substance of their work to others skilled in the art. These terms are here, and are generally, conceived to be a self-consistent sequence of steps leading to a desired result. The steps are those requiring physical manipulations of physical quantities. Usually, though not necessarily, these quantities take the form of electromagnetic signals capable of being stored, transferred, combined, compared, and otherwise manipulated.

It has proven convenient at times, principally for reasons of common usage, to refer to these signals as bits, values, elements, symbols, characters, terms, numbers, and the like. All of these and similar terms are to be associated with the appropriate physical quantities and are merely convenient labels applied to these quantities and actions. Unless specifically stated otherwise, or as may be apparent from the discussion, terms such as "processing," "computing," "calculating," "determining," "displaying," and the like, used herein refer to the action(s) and processes of a computer system, or similar electronic and/or mechanical computing device, that manipulates and transforms data, represented as physical (electromagnetic) quantities within the computer system's registers and/or memories, into other data similarly represented as physical quantities within the computer system's memories and/or registers and/or other such information storage, transmission and/or display devices.

Any of the above-disclosed embodiments of a method according to the present invention enables endpoint detection independent of the material being polished, allowing facile endpoint detection within a layer, as well as at layer boundaries. Additionally, any of the above-disclosed embodiments of a method of manufacturing according to the present invention enables semiconductor device fabrication with increased device accuracy and precision, increased efficiency and increased device yield, enabling a streamlined and simplified process flow, thereby decreasing the complexity and lowering the costs of the manufacturing process and increasing throughput.

The particular embodiments disclosed above are illustrative only, as the invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular embodiments disclosed above may be altered or modified and all such variations are considered within the scope and spirit of the invention. In particular, every range of values (of the form, "from about a to about b," or, equivalently, "from approximately a to b," or, equivalently, "from approximately a–b") disclosed herein is to be understood as referring to the power set (the set of all subsets) of the respective range of values, in the sense of Georg Cantor. Accordingly, the protection sought herein is as set forth in the claims below.

What is claimed:

1. A method comprising:

planarizing a dielectric layer disposed above a structure layer;

exciting surface plasmons in a conductive film disposed in the dielectric layer;

detecting photons reflected from the conductive film to determine a change in a surface plasmon resonant angle; and determining a thickness of the dielectric layer from the change in the surface plasmon resonant angle.

2. The method of claim 1, wherein exciting surface plasmons in the conductive film disposed in the dielectric layer comprises exciting surface plasmons using a grating disposed on the conductive film.

3. The method of claim 2, wherein detecting photons reflected from the conductive film to determine the change in the surface plasmon resonant angle comprises detecting a shift in a minimum in reflected photon intensity.

4. The method of claim 1, wherein exciting surface plasmons in the conductive film disposed in the dielectric layer comprises exciting surface plasmons using a prism disposed in a table of a planarization tool.

5. The method of claim 4, wherein detecting photons reflected from the conductive film to determine the change in the surface plasmon resonant angle comprises detecting a shift in a minimum in reflected photon intensity.

6. The method of claim 1, wherein exciting surface plasmons in the conductive film disposed in the dielectric layer comprises exciting surface plasmons using photons focused on a plane substantially coplanar with or parallel to a surface of the conductive film.

7. The method of claim 6, wherein detecting photons reflected from the conductive film to determine the change in the surface plasmon resonant angle comprises detecting a shift in a minimum in reflected photon intensity.

8. The method of claim 1, wherein detecting photons reflected from the conductive film to determine the change in the surface plasmon resonant angle comprises detecting a shift in a minimum in reflected photon intensity.

9. The method of claim 1, wherein exciting surface plasmons in the. conductive film disposed in the dielectric layer comprises exciting surface plasmons using collimated photons.

10. The method of claim 9, wherein detecting photons reflected from the conductive film to determine the change in the surface plasmon resonant angle comprises detecting a change in reflected photon intensity at an incident photon angle.

11. A method comprising:

planarizing a dielectric layer disposed above a structure layer;

exciting surface plasmons in a conductive film disposed in the dielectric layer using photons polarized substantially perpendicular to a plane substantially coplanar with or parallel to a surface of the conductive film;

detecting photons reflected from the conductive film to determine a change in a surface plasmon resonant angle; and determining a thickness of the dielectric layer from the change in the surface plasmon resonant angle.

12. The method of claim 11, wherein exciting surface plasmons in the conductive film disposed in the dielectric layer comprises exciting surface plasmons using a grating disposed on the conductive film.

13. The method of claim 12, wherein detecting photons reflected from the conductive film to determine the change in the surface plasmon resonant angle comprises detecting a shift in a minimum in reflected photon intensity using a charge-coupled device (CCD) detector.

14. The method of claim 11, wherein exciting surface plasmons in the conductive film disposed in the dielectric layer comprises exciting surface plasmons using a prism disposed in a table of a planarization tool.

15. The method of claim 14, wherein detecting photons reflected from the conductive film to determine the change in the surface plasmon resonant angle comprises detecting a shift in a minimum in reflected photon intensity using a charge-coupled device (CCD) detector.

16. The method of claim 11, wherein exciting surface plasmons in the conductive film disposed in the dielectric layer comprises exciting surface plasmons using laser photons focused on the plane substantially coplanar with or parallel to the surface of the conductive film.

17. The method of claim 16, wherein detecting photons reflected from the conductive film to determine the change in the surface plasmon resonant angle comprises detecting a shift in a minimum in reflected photon intensity using a charge-coupled device (CCD) detector.

18. The method of claim 11, wherein detecting photons reflected from the conductive film to determine the change in the surface plasmon resonant angle comprises detecting a shift in a minimum in reflected photon intensity using a charge-coupled device (CCD) detector.

19. The method of claim 11, wherein exciting surface plasmons in the conductive film disposed in the dielectric layer comprises exciting surface plasmons using collimated laser photons.

20. The method of claim 19, wherein detecting photons reflected from the conductive film to determine the change in the surface plasmon resonant angle comprises detecting a change in reflected photon intensity at an incident photon angle using a charge-coupled device (CCD) detector and photons polarized substantially parallel to the plane substantially coplanar with or parallel to the surface of the conductive film and normalizing reflectivity of the photons polarized substantially perpendicular to the plane with reflectivity of the photons polarized substantially parallel to the plane.

21. A method, comprising:

planarizing a dielectric layer disposed above a structure layer using a planarization process, said dielectric layer having a conductive film positioned therein;

transmitting light through the dielectric layer such that at least a portion of the light reflects from the conductive film and excites surface plasmons in the conductive film;

detecting an intensity of the reflected light; and determining an endpoint of the planarization process based on the intensity of the reflected light.

22. The method of claim 1, wherein the conductive film comprises a grating structure, and wherein transmitting the light through the dielectric layer such that at least the portion of the light reflects from the conductive film comprises transmitting the light through the dielectric layer such that at least the portion of the light reflects from the grating structure.

23. The method of claim 21, wherein determining the endpoint of the planarization process based on the intensity of the reflected light comprises determining a thickness of the dielectric layer based on the intensity of the reflected light.

24. The method of claim 23, wherein determining the thickness of the dielectric layer based on the intensity of the reflected light comprises detecting a change in a surface plasmon resonant angle based on the intensity of the reflected light.

25. The method of claim 24, wherein detecting the change in the surface plasmon resonant angle comprises detecting a shift in an intensity minimum of the reflected light.

26. The method of claim 21, wherein transmitting the light through the dielectric layer comprises transmitting light polarized parallel to a plane of the conductive film.

27. The method of claim 21, wherein transmitting the light through the dielectric layer comprises transmitting the light comprises transmitting the light through a prism deployed between a light source and the dielectric layer.

28. The method of claim 21, wherein transmitting light through the dielectric layer comprises transmitting laser light through the dielectric layer.

29. A method, comprising:

forming a first dielectric layer above a semiconductor structure layer;

forming a conductive film in the first dielectric layer;

forming a second dielectric layer above the conductive film and at least a portion of the first dielectric layer such that the conductive film is bounded on all sides by the first and second dielectric layers;

planarizing a surface of the second dielectric layer;

transmitting light through the surface and into the second dielectric layer such that at least a portion of the light reflects from the conductive film and excites surface plasmons in the conductive film;

detecting an intensity of the reflected light emerging from the surface of the second dielectric layer; and determining an endpoint of the planarization process based on the intensity of the reflected light.

30. The method of claim 29, wherein forming the conductive film comprises forming a grating structure.

31. The method of claim 30, wherein forming the grating structure comprises:

forming a first portion of the conductive film in the first dielectric layer;

forming a third dielectric layer above the first portion of the conductive film;

patterning the third dielectric layer to expose a plurality of areas of the first portion of the conductive film;

forming a second portion of the conductive film above the third dielectric layer and the first portion of the conductive film such that the second portion of the conductive film contacts the plurality of exposed areas of the first portion of the conductive film; and planarizing the second portion of the conductive film.

32. The method of claim 31, wherein patterning the third dielectric layer to expose the plurality of areas of the first portion of the conductive film comprises pattering the dielectric layer to form trenches of differing widths.

33. The method of claim 30, wherein forming the grating structure comprises forming the grating structure by scoring or grooving the conductive film.

34. The method of claim 31, wherein patterning the third dielectric layer to expose the plurality of areas of the first portion of the conductive film comprises pattering the dielectric layer to form trenches of differing depths.

35. The method of claim 29, wherein determining the endpoint of the planarization process based on the intensity of the reflected light comprises determining a thickness of the dielectric layer based on the intensity of the reflected light.

36. The method of claim 35, wherein determining the thickness of the dielectric layer based on the intensity of the reflected light comprises detecting a change in a surface plasmon resonant angle based on the intensity of the reflected light.

37. The method of claim 36, wherein detecting the change in the surface plasmon resonant angle comprises detecting a shift in an intensity minimum of the reflected light.

38. The method of claim 29, wherein planarizing the surface of the second dielectric layer comprises performing a chemical mechanical planarization of the surface.

* * * * *

UNITED STATES PATENT AND TRADEMARK OFFICE

CERTIFICATE OF CORRECTION

PATENT NO. : 6,613,594 B1 
DATED : September 2, 2003
INVENTOR(S) : Christopher Hans Lansford and Jeremy Sam Lansford It is certified that error appears in the above-identified patent and that said Letters Patent is hereby corrected as shown below:

Column 5,
Line 30, replace "cylindricai" with -- cylindrical --.

Signed and Sealed this

Twenty-first Day of October, 2003

JAMES E. ROGAN
*Director of the United States Patent and Trademark Office*